United States Patent [19]

Harding et al.

[11] Patent Number: 4,895,400

[45] **Date of Patent: * Jan. 23, 1990**

[54] SLIDE LATCH FOR CABANA DOORS

[75] Inventors: George W. Harding; George Hiskes, both of Whiting, Ind.

[73] Assignee: Poly-John Enterprises Corp., Whiting, Ind.

[ * ] Notice: The portion of the term of this patent subsequent to Dec. 27, 2005 has been disclaimed.

[21] Appl. No.: 247,729

[22] Filed: Sep. 22, 1988

Related U.S. Application Data

[63] Continuation of Ser. No. 20,571, Mar. 2, 1987, Pat. No. 4,793,100.

[51] Int. Cl.[4] ..... E05C 1/10

[52] U.S. Cl. ..... 292/145; 292/DIG. 38; 292/DIG. 57; 49/394

[58] Field of Search ..... 292/145, 57, DIG. 38, 292/DIG. 57, DIG. 53, DIG. 54, 146, 150, 147, 152, 337, DIG. 51, DIG. 55; 49/394

[56] References Cited

U.S. PATENT DOCUMENTS

| | | | |
|---|---|---|---|
| 338,463 | 3/1886 | Barrett | 292/145 X |
| 569,724 | 10/1896 | Oestmann | 292/145 |
| 635,031 | 10/1899 | Baker | 292/145 |
| 831,283 | 9/1906 | Hinman et al. | 292/145 |
| 838,644 | 12/1906 | Rapson | 292/145 |
| 1,574,222 | 2/1926 | Wensel | 292/145 X |
| 2,169,743 | 8/1939 | Schlage | 292/145 |
| 2,676,826 | 4/1954 | Smith | 292/175 |
| 2,692,789 | 10/1954 | Rivard | 292/DIG. 38 X |
| 3,126,218 | 3/1964 | Andrews | 292/145 X |
| 3,469,875 | 9/1969 | Ahlgren | 292/DIG. 38 X |
| 4,169,617 | 10/1979 | Koeneman et al. | 292/149 |

*Primary Examiner*—Gary L. Smith
*Assistant Examiner*—Eric K. Nicholoson
*Attorney, Agent, or Firm*—Harness, Dickey & Pierce

[57] ABSTRACT

A slide latch for latching the leading edge of a door, formed of a plastic panel, to an adjacent jamb-like member, is formed of a narrow, thin, horizontally elongated, flat plate positioned upon the door surface for sliding movement towards and away from the jamb-like member. Integral, narrow, rigid flanges, forming sled-like runners, are formed along the horizontally elongated side edges of the slider for slidable engagement with the panel surface. The slider is held within an open-ended, horizontally elongated, flattened loop that is struck-out of the panel. Stops are formed near the opposite ends of the slider for engaging the ends of the loops and thereby limiting the sliding movement of the slider. One of the stops may be enlarged to form a manual grip for moving the slider. The slider may be initially installed in, or removed for replacement from, the loop by pulling the slider with sufficient manually applied force to cause the loop to resiliently deflect to permit passage of the smaller stop through the loop. A cover panel over the struck-out area has a cut-out window, through which selected portions of indicia located on the slider can be visually seen.

7 Claims, 1 Drawing Sheet

SLIDE LATCH FOR CABANA DOORS

This is a continuation of copending application Ser. No. 020,571, now U.S. Pat. No. 4,793,100, filed Mar. 2, 1987.

BACKGROUND OF INVENTION

Small-size cabanas that are used for outhouse-type toilets and similar types of small-size building constructions are typically made of plastic panels or sheets which are secured together to form the walls of the structure. A door, made of plastic panels, is hinged to a doorway opening in the cabana and is provided with a latch for holding the door in closed position. Various types of latches have been used, including slide bolts.

Such cabanas, particularly those used for outhouse-type toilets, are subject to damage by exposure to the varying weather elements, by abuses in transporting the units to and from their use sites and by careless users and vandals. As a result their inside latches are frequently broken or otherwise disabled so they are not properly usuable. However, providing an inexpensive latch that is strong enough to resist breakage or weather-induced damage has been difficult and impractical. That is, a heavy and costly latching construction is needed to avoid most common damages due to changes in temperature, effects of the sun and other weathering elements, impacts and mishandling abuses. Additionally, the needed size and weight of a really sturdy unit is impractical. Consequently, during substantial portions of the time that such cabanas are used, their latches are either inoperative or do not operate easily enough for ordinary manual use.

Hence, there has been a need for a low cost, light weight inside latching construction which is sufficiently rigid and strong as to resist common weather and misuse damages. This invention herein relates to such an improved latch construction.

SUMMARY OF INVENTION

This invention contemplates forming a slide latch out of the plastic molding, in the shape of a thin, elongated, wide plate having a tongue-like end for engaging with a jamb member adjacent the leading edge of a door panel. The latch slider is positioned upon the inside of the door panel, for horizontally slidable movement, within a flattened loop which is struck-out of the door panel adjacent its leading edge. The slider is provided with rigid, narrow, integral side edge flanges. These flanges form sled-like runners that engage the door portions which they overlie. Also, these flanges rigidify and reinforce the slider plate to greatly resist breaking, warping, bending or twisting of the slider.

Further, the sled-like runners, because of their narrow line contact with the panel surfaces, substantially reduce the area of frictional contact between the slider and the panel to permit easy sliding operation with relatively light manual force. Consequently, a relatively large size slider may be used because the amount of manual force needed to operate the slider is not excessive.

The improved latch slider of this invention is formed in a simple configuration which can be easily molded of a plastic material of a type which provides a relatively slippery surface. Consequently, the cost of such sliders is low, and the weight of the slider latch construction is minimal.

The slider receiving loop may be integrally formed of a struck-out portion of the door panel. This leaves an opening in the panel which can be covered by a cover panel sheet. By providing a window in the cover panel sheet, useful indicia located upon the slider can be read through the window. For example, by imprinting the words "in use", "open" or "vacant" etc., upon the slider surface, such indicia can be read through the window by a prospective user.

One object of this invention is to provide a simplified, strong latch which is particularly resistant to damage from outdoor, adverse weather conditions as well as damages from impacts, mishandling or vandalism. In addition, an object is to provide a low cost construction which may be easily replaced without the use of tools, when necessary.

A further object of this invention is to provide a low friction, minimal operating force, latch slider which resists breakage, bending, twisting or warping caused by changes in temperature and other climatic conditions.

These and other objects and advantages of this invention will become apparent upon reading the following description, of which the attached drawings form a part.

DETAILED DESCRIPTION

Figure 1:
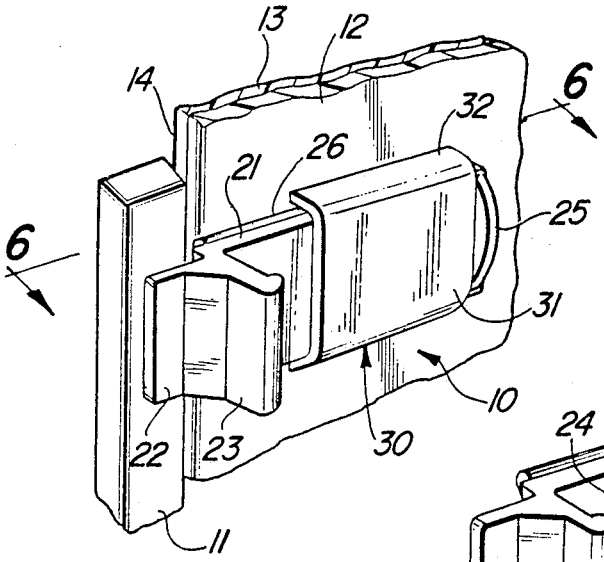
FIG. 1 is a perspective, fragmentary view of adjacent portions of a door and jamb latched together by the slide latch of this invention.

FIG. 1 schematically illustrates a door 10 latched to a jamb-like member 11, which may be the vertical frame member or jamb of a doorway, etc. In cabana or outhouse structures, such doors are typically made of large plastic panels which may be flat or may have impressed indentations formed therein. For illustrative purposes, the door 10 is shown as being formed of a thin, plastic, inner panel 12 and a plastic outer, cover panel 13. The two panels are secured together in any coventional manner. Typically, this type of door construction, utilizing inner and outer panels, has the panels provided with indentationsn so that the panels have portions arranged in face-to-face contact where they are joined together and other portions that are spaced apart. The particular construction of the door or the door panels is not material to this invention and, therefore, is illustrated schematically.

Typically, in this type of door or panel construction, hinges are provided along one vertical side edge of the door (not shown) and the opposite door leading edge 14 is arranged to be aligned with the jamb-like member 11 when the door is closed.

The latch is formed of a slider 20 which has a body portion 21 that is wide, elongated, flat and thin. The leading edge of the slider is provided with a tongue 22 for engaging the jamb-like member. That engagement may simply involve the tongue abutting, in face-to-face contact, an exposed portion of the jamb-like member or, in some constructions, it may involve forming a socket in the jamb-like member to receive the tongue.

A hand grip flange 23, extending perpendicularly to the body portion 21, forms both a manual grasping means as well as a stop means, as will be further described. The free end of the flange 23 is provided with a rounded bead 24 to enable better manual grasping as well as for appearance purposes. A raised, rear rib 25 formed on the opposite end of the slider body portion 21, forms a stop or limit means.

Elongated, narrow, integral flanges 26 are formed on the outer surface of the body portion along the opposite elongated edges. These flanges form sled-like runners. For that purpose, the flanges are preferably rounded in cross-section to form rounded free edges 27.

The slider is formed of an integral plastic molding of any suitable commercially available material. However, it is desired that the surface of the slider be smooth and relatively slippery. Hence, the plastic chosen should have those characteristics. The choice of the plastic is within the knowledge of the skill of the art depending upon availability, cost, etc.

The slider is arranged upon the inner surface of the door 10, that is, the surface of the door which would be inside the cabana. The slider is fitted within a struck-out, U-shaped in cross-section receptable 30 which is shaped like a flat loop. This forms a horizontally-oriented guide for holding the slider in position upon the door surface. The struck-out loop has a flat base 31 and integral legs 32 that join the base to the inner panel 12. Preferably, the loop is integral with the panel 12. However, the loop may also be formed as a separate member which is mechanically fastened, as by heat welding or by rivets or the like, to the panel 12.

Figure 4:
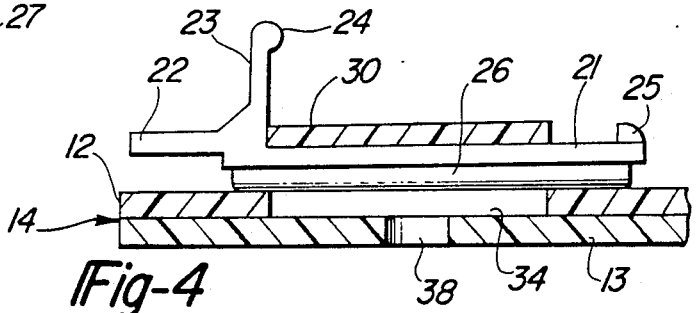
FIG. 4 is a cross-sectional plan view of the slider positioned upon the door and taken as if in the direction of arrows 4—4 of FIG. 6.
Figure 6:
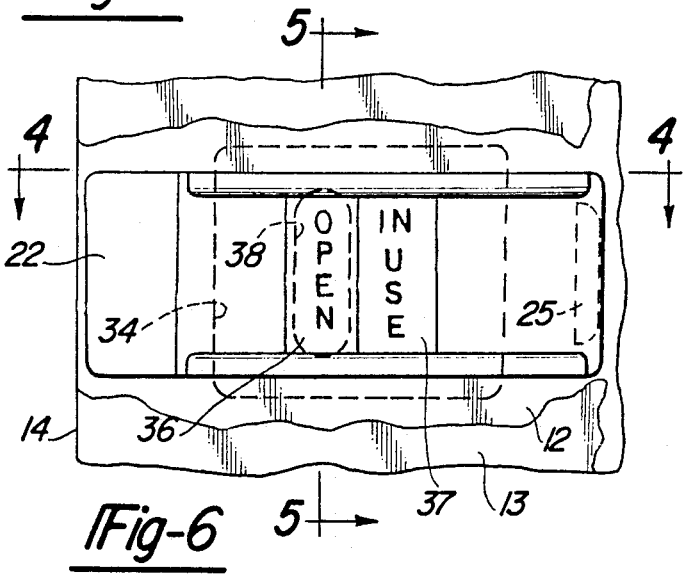
FIG. 6 is a fragmentary, elevational view of the slider portion of the door viewed from the outside of the door and is taken as if in the direction of arrows 6—6 of FIG. 1.

Because of the struck-out loop, the area of the panel 12 from which the loop is cut or struck-out leaves an opening 34 (see FIGS. 4 and 6). Thus, the outer surface of the slider, which is located between the flanges or runners 26, is exposed to view through that opening 34.

An indicia band 36 and an adjacent indicia band 37 is applied upon the exposed surface of the slider. Each indicia band is intended to give a message which is visible through a vertical elongated, narrow window opening 38 formed in the portion of the cover panel 13 which overlies the slider. By way of example, one indicia band 36 may state "open" while another may state "in use" or similar messages.

Figure 2:
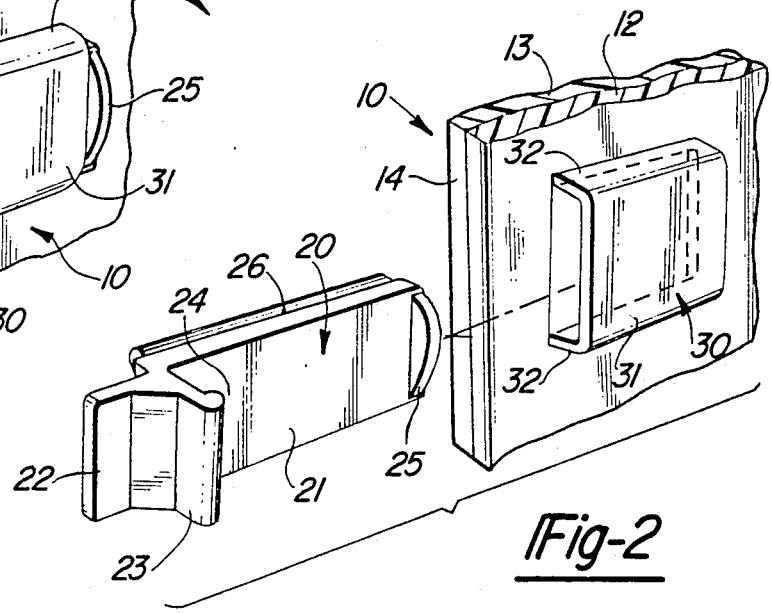
FIG. 2 is a perspective, fragmentary view of the door edge with the latch slider pulled out from the door slider receptacle or guide loop.
Figure 3:
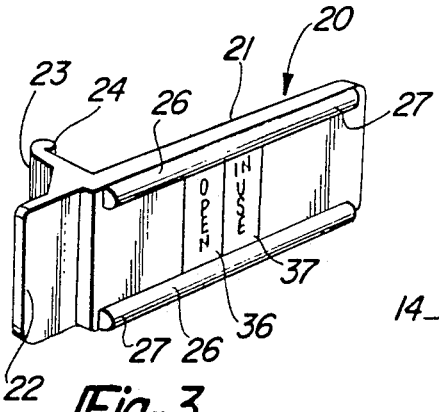
FIG. 3 is a perspective view of the front face of the slider.

In operation, the slider 20 is mounted within the receptacle or loop 30 by positioning it as shown in FIG. 2 at the leading edge of the door. Then, the slider is manually pushed through the loop so that its rear rib 25 is forcibly slid through the loop. The force of the moving rib, which has a curved end portion, causes the loop base to momentarily deflect resiliently, as it is made out of a plastic which has some inherent resiliency, so that the rib passes through the loop. After the rib 25 passes through the loop, it functions as a stop means or limit means to limit the sliding movement of the slider in the direction of the jamb. The movement of the slider away from the jamb-like member is limited by the hand grip flange 23 which forms a stop means for the opposite direction (See FIG. 4).

When the slider is moved into latching position where its tongue overlaps the jamb-like member 11, or fits into a suitable socket in the jamb-like member 11, the indicia band 37, which illustratively states "in use" is visible through the window opening 38 in the cover panel 13 to a person standing outside of the cabana and looking at the outside surface of the door. Conversely, when the slider is slid into the unlatching position (as in FIG. 4), the indicia band 36 is visible through the window opening 38 to state "open" oro the like to one standing on the outside of the cabana.

Figure 5:
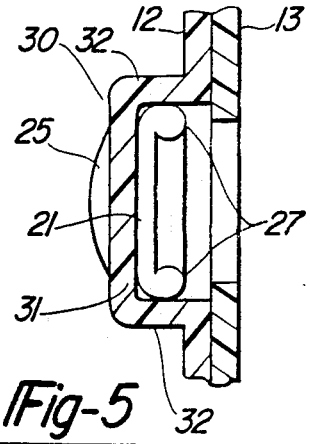
FIG. 5 is a cross-sectional end view of the slider mounted upon the door and taken as if in the direction of arrows 5—5 of FIG. 6.

The rounded edge surface 27 of the flanges 26 minimize the frictional contact between the slider and the body of the plastic inner panel 12. In addition, as shown in FIG. 5, the curvature of the sides of the rounded flanges reduce their areas of contact with the inner surfaces of the legs 32 of the loop 30. Thus, the slider is somewhat like a sled whose runners contact the snow along narrow lines or bands to reduce the amount of friction and thereby enable movement with less force.

The integral flanges 26 not only function as runners to enable easier movement of the slider, but also form reinforcing edge flanges which rigidify the thin body portion 21 of the slider. Moreover, the flanges resist bending, twisting or warping of the latch which may otherwise result from substantial changes in weather conditions, as for example, sharp changes in temperature.

While the latch of this invention is illustrated as used with a toile cabana or a similar type of outhouse construction, it may also be usable in other structures. Thus, it is desired that the invention herein be construed in accordance with the attached claims.

Having fully described an operative embodiment of this invention, I now claim:

1. A slide latch for latching the leading edge of a door panel of a cabana-like structure to a jamb-like member, with said panel being hinged so that its leading edge is arranged to be aligned with the jamb-like member, comprising:

a slider comprising an elongated, generally flat, rectangular-shaped, wide body portion which is arranged upon a surface of the panel for sliding in its elongated, lengthwise direction into latching engagement with an engagement portion of the jamb-like member;

said body portion having a lead end for arrangement at the jamb-like member, and a rear end, with two, opposite, elongated side edges extending the length of said body portion between said ends, and a pair of opposing faces on the opposite sides of the body portion;

an integral, narrow, rigid, elongated rib formed upon the surface of the body portion that faces said panel surface at each elongated side edge of the body portion and arranged in sliding engagement with said panel surface;

said ribs being of substantially uniform, narrow cross-section along their lengths and each having a narrow, elongated free edge surface which overlies and slidably engages its adjacent panel surface portions, with the body portion being otherwise out of engagement, that is, spaced a short distance from, said panel surface;

a loop on said panel surface arranged to extend around the body portion, which extends through the loop, for holding the body portion of the slider upon the panel and for guiding its sliding movement, with said loop being arranged between the opposite ends of the body portion and being considerably shorter in length then said body portion;

a tongue integral with said body portion and extending, substantially coplanar with the body portion, from said lead end substantially parallel to the panel surface, with said tongue being engagable with the jamb-like member;

a raised stop flange formed integral with said body portion and extending from said rear end of said body portion substantially normal to the surface of said body portion opposite said surface that faces said panel, and being engageable with said loop to limit the sliding movement of the slider towards the jamb-like member;

a second, flange-like member integral with the lead edge of the body portion and extending substantially normal to the surface of said body portion opposite its surface that faces said panel, and being engageable with the opposite end of the loop for limiting the sliding movement of the slider away from the jamb-like member and also for grasping the slider for manually sliding it relative to the loop so as to form a grip which is integral with the body portion.

2. A slide latch as defined in claim 1, and including an opening formed in the panel, which opening is located beneath and is covered by said loop;

indicia applied upon the surface of said body portion that faces the panel surface, with the indicia located between said ribs so that preselected portions of the indicia are visible through the opening formed in the panel and with the preselected portions of the indicia being visible through the panel, depending upon whether the slider is arranged in a latching position or an unlatching position.

3. A slide latch as defined in claim 1, and including said loop being formed of a resiliently flexible material which can be resiliently expanded, to some degree, away from the panel surface, and the flange on the slider rear end being of a size for forcibly inserting it endwise through the loop, and thereby distorting the loop for passage of the flange therethrough until the flange passes completely through the loop, so that the loop may return to its initial, pre-distorted condition for retaining the slider therein, whereby the slider may be removed and replaced when desired.

4. A cabana-like structure including a door panel hinged over a door opening and having a leading edge for alignment with a jamb-like member arranged at the opening which the panel closes, comprising:

a slide latch including an elongated, substantially rectangular-shaped slider body portion arranged upon a surfce of the panel near said leading edge for sliding in a lengthwise direction into laching engagment with an adjacent portion of the jamb-like member;

said body portion having a lead end and an opposite rear end formed by the narrow edges of the rectangular-shaped configuration, and two opposite faces and two elongated side edges running along the length of the body portion between said ends;

a flattened, open-ended loop struck out of said panel, with the body portion extending through the loop for holding the body portion upon the panel and for guiding its sliding movement endwise towards and away from said jamb-like member;

a tongue integrally formed with said body portion and extending substantially coplanar from said lead end of the body portion and substantially parallel relative to the surface of the panel, with said tongue being engagable with said jamb-like member;

an integral raised stop flange formed on said body portion at the rear end thereof, and being substantially normal to the surface of said body portion, with the stop being engagaable with one of said loop for limiting the sliding movement of the slider towards the jamb-like member; and a grip flange integral with said body portion lead end and extending substantially normal to the surface of the body portion, with said grip flange located where the tongue and body portion are integrally joined so that the grip flange abuts said jamb-like member when the slider is moved towards said jamb-like member and, in addition, the grip flange engages the adjacent end of the loop for limiting the movement of the slider when the slider is moved away from said jamb-like member.

5. A construction as defined in claim 4, wherein an indicia is applied upon the surface of said body portion that faces said panel surface, and with the indicia being arranged so that preselected portions of the indicia are visible through an opening formed in the panell by the struck-out loop, with the position of the preselected portion of the indicia depending upon whether the slider is arranged in latching position or in unlatching position.

6. A construction as defined in claim 4, including said loop being resiliently deformable wherein the slider may be slid, with its rear end flange through the loop, distoring the loop while extending therethrough, for inserting the slider through the loop, and the slider regains its normal condition following the rear flange movement out of the loop for thereby permitting removal and replacement of the slider from the loop.

7. A cabana-like structure including a door panel hinged over a door opening and having a leading edge for alignment with a jamb-like member arranged at the opening which the panel closes, comprising:

a slide latch including an elongated, substantially rectangular-shaped slider body portion arranged upon a surface of the panel near said leading edge for sliding in a lengthwise direction into latching engagement with an adjacent portion of the jamb-like member;

said body portion having a lead end and an opposite rear end formed by the narrow edges of the rectangular-shaped configuration, and two opposite faces and two elongated side edges running along the length of the body portion between said ends;

an open loop secured to said panel, with the body portion extending through the loop for holding the body portion upon the panel and for guiding its sliding movement endwise towards and away from said jamb-like member;

a tongue integrally formed with said body portion and extending substantially coplanar from said lead end of the body portion and substantially parallel relative to the surface of the panel, with said tongue being engagable with said jamb-like member;

an integral raised stop flange formed on said body portion at the rear end thereof, and being substantially normal to the surface of said body portion, with the stop being engagable with one of said loop for limiting the sliding movement of the slider towards the jamb-like member; and a grip flange integral with said body portion lead end and extending substantially normal to the surface of the body portion, with said grip flange located where the tongue and body portion are integrally joined so that the grip flange abuts said jamb-like member when the slider is moved towards said jamb-like member and, in addition, the grip flange engages the adjacent end of the loop for limiting the movement of the slider when the slider is moved away from said jamb-like member.

* * * * *